United States Patent [19]

Soisson

[11] 3,937,463

[45] Feb. 10, 1976

[54] CONGRUENT SUSPENSION TWIST SWING

[76] Inventor: Donald R. Soisson, 1160 Bresee Ave., Pasadena, Calif. 91104

[22] Filed: Sept. 24, 1974

[21] Appl. No.: 508,816

[52] U.S. Cl. ..... 272/85; 24/129 D; 248/341

[51] Int. Cl.[2] ..... A63G 9/00

[58] Field of Search ..... 272/85, 86, 87, 88, 89, 272/90; 248/340, 341

[56] References Cited

UNITED STATES PATENTS

| | | | |
|---|---|---|---|
| 2,701,604 | 2/1955 | St. Louis | 272/85 |
| 3,130,969 | 4/1964 | Groth | 272/85 |
| 3,447,802 | 6/1969 | Grudoski | 272/87 |
| 3,712,614 | 1/1973 | Sherman | 272/85 |

OTHER PUBLICATIONS

Popular Mechanics, pg. 78, 8/1972.

*Primary Examiner*—Richard C. Pinkham
*Assistant Examiner*—T. Brown
*Attorney, Agent, or Firm*—Wm. Jacquet Gribble

[57] ABSTRACT

A swing for both arcuate and rotational motion has a disc platform for passengers and multiple, congruently attached support strands adapted for securing to a horizontal support member. The bight of a strand passes around the support member such that two free ends of the strand may pass through the disc to locks to adjustably secure the ends to the disc. The strand pairs are fixed to the horizontal support member at spaced positions on the member congruent with the position of the strands on the disc. The disc is provided with a peripheral rim having top and bottom walls. Extending through the walls are a plurality of spaced apart vertical apertures. The lower wall is provided with a depression placed adjacent each aperture. Extending across the depression and spaced from the bottom of the depression is a rigidly attached lock bar. The disc platform is swingedly attached to the support by passing each end of each strand pair through a vertical aperture and each end is then passed between the bottom of the depression and the lock bar and anchored at that point.

4 Claims, 12 Drawing Figures

CONGRUENT SUSPENSION TWIST SWING

BACKGROUND OF THE INVENTION

The invention relates to amusement devices and more particularly to amusement swings for use by children of all ages. The swing is one of man's oldest amusement devices and many swing variations have been developed through the centuries. Variations are still being developed as exemplified by U.S. Pat. No. 3,130,969 issued Apr. 28, 1964 to R. W. Groth and U.S. Pat. No. 3,145,990 issued to W. E. Prouty Aug. 25, 1964. Such swings are adapted to suspension by chain, rope or other lines in accordance with the load to which they will be subjected. Attempts have been made to develop swings that not only move in an arc under the suspension member but which may rotate and gyrate as they swing. Previous swings of the "twist-up" type have not been able to take full advantage of the force of gravity because of the strand arrangement at the support point. I have invented a congruent suspension twist swing which not only gives the amusing arcuate, rotational and revolving motions but which enables users to benefit from the full gravitational force to achieve high speed spin down and repeated up and down twist cycles by merely pre-twisting the strands one time.

SUMMARY OF THE INVENTION

The invention contemplates a swing to be supported from a horizontal support, which may be either an extending tree limb or a metallic or wooden support frame, said swing being capable of both arcuate and rotational motion. The swing comprises a rider support disc having an upstanding peripheral rim and vertical perforations through the rim and disc for anchoring support strands. Means for attaching the strands at spaced positions about the horizontal support member combine with means for adjustably securing each opposite end of a strand pair adjacent the vertical perforations through which the strands pass in the disc. The ends of the strands are congruent at the disc with the strand pattern where they are fixed to the horizontal support member. A plurality of strand pairs may be utilized.

In a preferred embodiment the strand end anchor comprises a downwardly opening cup in the disc bottom across which a lock bar extends. When the bight of the strand of a pair is secured to the horizontal support member the position of the disc both as to horizontal attitude and to height above the ground surface may be adjusted by the amount of strand end passed around the lock bar and between the disc bottom and the remainder of the strand that has passed through the vertical perforations. The lock is secure because stress upon the strand tends to impress upon the end passed beneath the strand so that the more stress on the strand the tighter the lock.

Additional alternate means of securing the strand bight to the horizontal support member may comprise a horizontal plate perforated at its periphery and means to secure the plate to the limb or other support such that the strand pairs may be located in spaced positions with respect to the support congruent with the position of the strand ends with respect to the disc.

All of the elements of the inventive combination may be commercially obtained or fabricated by accepted manufacturing technique. The swing of the invention is simple to install, easy to operate and affords great amusement because of its versatility of motion. A foot rest rim may be a part of the inventive combination as a safety measure and a structural reinforcement.

These and other advantages of the invention are apparent from the following detailed description and accompanying drawing.

DESCRIPTION OF THE PREFERRED EMBODIMENTS

Figure 1:
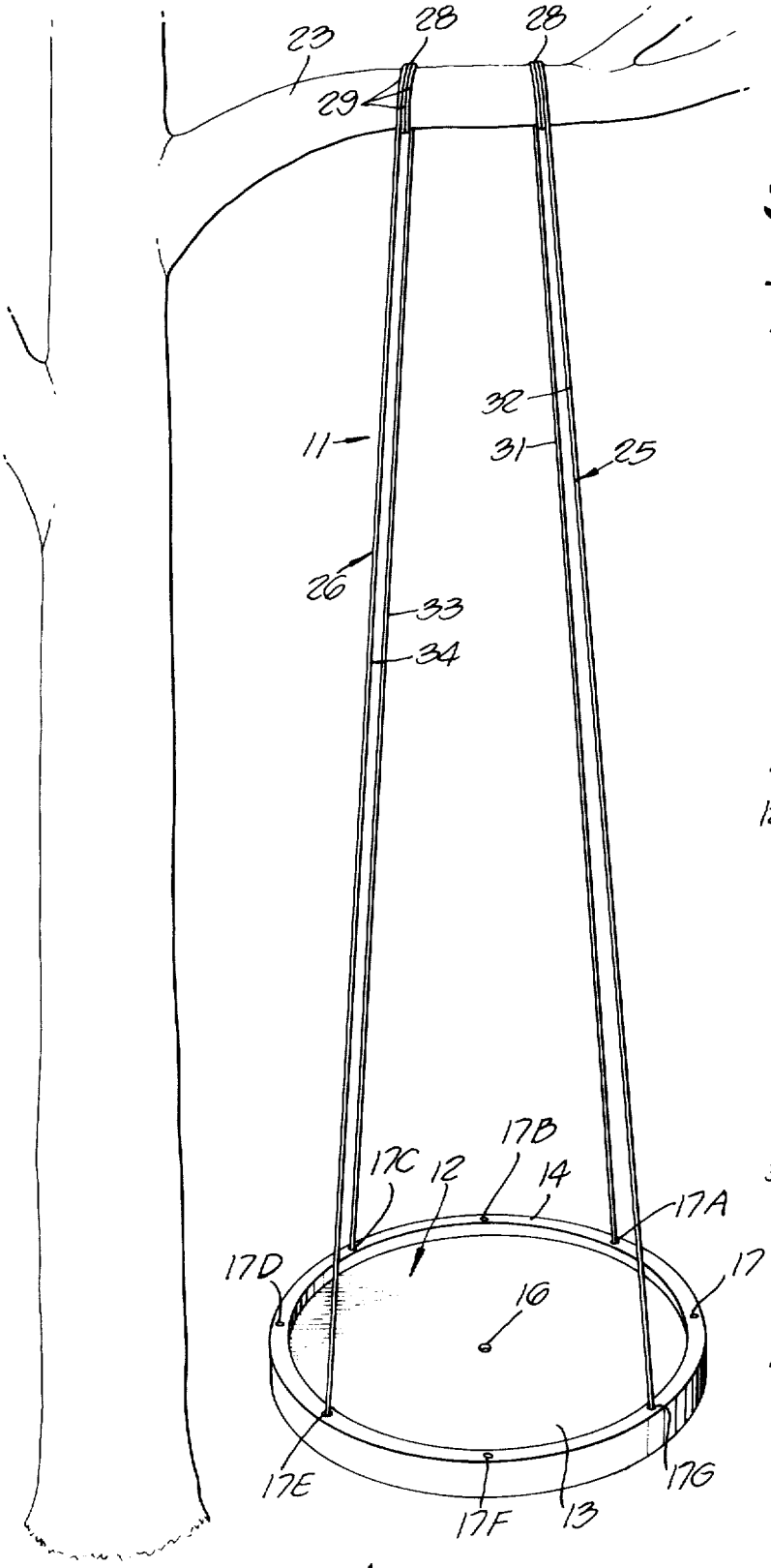
FIG. 1 is a perspective view of a swing in accordance with the invention supported by a tree limb.

In the various Figures the like elements are identified by like reference numbers.

FIGS. 1 through 4 show a twist swing 11 in accordance with the invention and comprising a circular user platform or disc 12 having a floor 13 and an upraised peripheral rim 14. The platform has a central drain hole 16.

Figure 3:
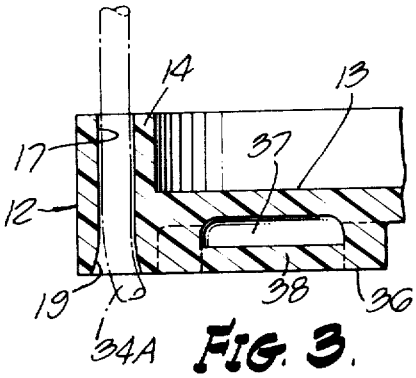
FIG. 3 is a fragmentary sectional elevation taken along line 3—3 of FIG. 2.

A plurality of cirumferentially spaced vertical perforations 17, 17A, 17B, 17C, 17D, 17E, 17F and 17G extend through the rim. FIG. 3 best shows the location of the vertical perforations 17 with respect to the disc.

Figure 2:
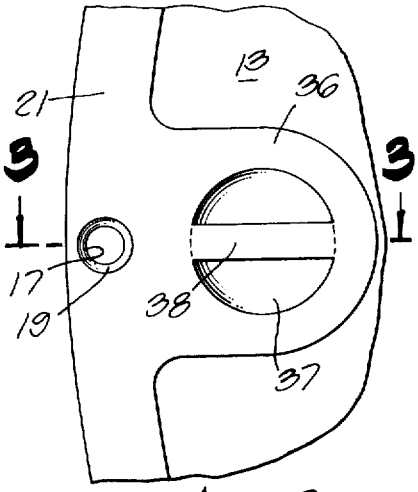
FIG. 2 is a fragmentary bottom plan view showing the strand end lock of the invention.

As can be seen from FIG. 2, platform or disc floor 13 is surrounded by rim 14 which extends both above and below the platform. Perforations 17 are seen to flare outwardly at 19 at the bottom end of each perforation. The flare eliminates the sharp edge which otherwise results as the cylindrical perforation emerges at the bottom surface 21 of the rim.

The disc platform 12 is supported from a horizontal support member, which in the embodiment of FIG. 1 is a tree limb 23, by two pairs of support strands 25, 26. Each strand pair is a continous strand which is shown in FIG. 1 as a rope or cable the central bight 28 of which is looped about the tree limb in a plurality of securing loops 29. Strand pair 25 comprises strand 31, 32, while strand pair 26 comprises strands 33, 34. Strands 33, 34 pass through perforations 17C and 17E respectively, while strands 31, 32 pass respectively through perforations 17A, 17G. The utilized perforations for each pair are thus on a chord of the circle of the disc, making the strand pattern at its ends congruent with the strand pattern of spacing at the support member or limb 23.

Figure 9:
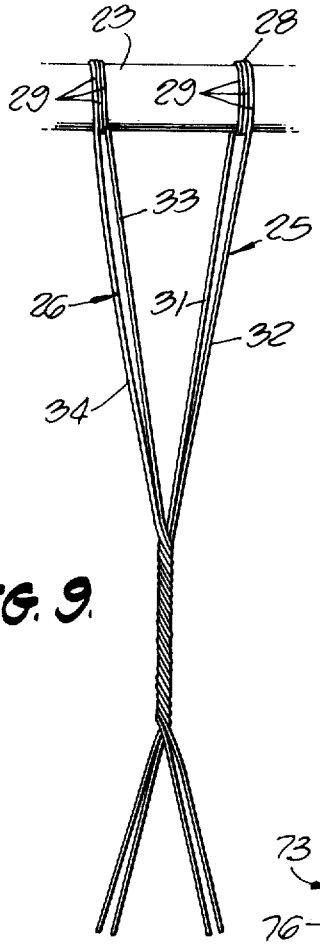
FIG. 9 is a fragmentary elevation of the embodiment of FIG. 1 showing the "twisted up" position of the swing.

It has been found that a disc with a diameter of approximately 60 inches suspended from a horizontal member approximately 15 feet above the ground gives a satisfying amusement ride. The energy needed to twist the strand pairs 25, 26 about each other as shown in FIG. 9 is within the power of the average small child. As the resilience of the strands and the downward gravitational pull affect the unwinding of the pairs of strands, the rotation of the disc increases in speed such that when the strand pairs are completely unwound there is sufficient momentum to rewind the pairs, thus lifting the users of the swing and conditioning the strands in the configuration of FIG. 9 for a secondary unwinding and descent. Experience has shown that as many as five secondary rotations may thus be obtained from the single initial twisting of the strands about each other.

This benefit is believed due to the spacing of the strand pairs at the horizontal member. The resultant of the gravitational pull is enhanced by this spacing rather appreciably above that obtained when a single point of suspension is used.

Figure 4:
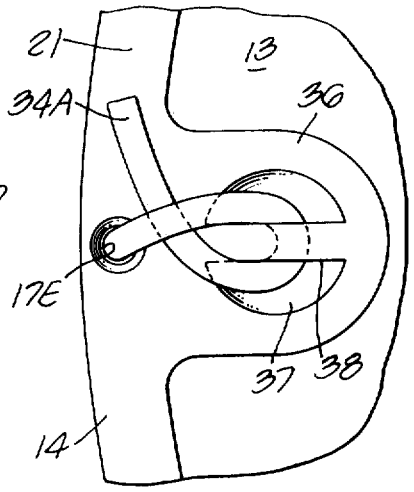
FIG. 4 is a view similar to FIG. 2 with the strand end shown in locked position.

There are times when the strands stretch due to weather changes or slight fatigue and it is necessary to adjust the secured lengths of the strand ends at the bottom of the disc. Such adjustment is easily accomplished with the apparatus of the invention when there is no load on the disc platform. In FIGS. 2, 3 and 4 the lock element of the disc is shown. The lock comprises a peripheral boss 36 which extends inwardly from the rim 14. The boss is generally semi-cylindrical in configuration and has a central aperature 37 across which a radial lock bar 38 extends. Aperature 37 is preferably cylindrical in configuration and is bridged by a radial lock bar 38, such that a strand end such as the end 34A may be passed beneath the bar within the aperature and then back between itself and the adjacent bottom surface of the lock.

When the disc has no load strand end 34A is movable with respect to the lock bar 38 so as to adjust the effective length of the strand with respect to the support to change or restore the horizontal attitude of the disc or its heights above the ground.

Figure 5:
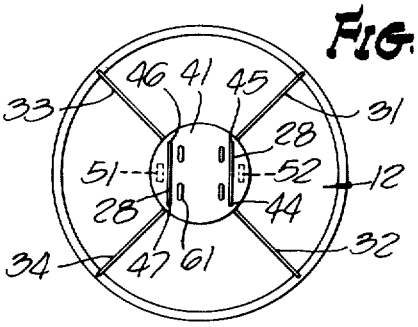
FIG. 5 is a schematic plan view of an alternate embodiment of the invention employing a strand-securing plate.
Figure 6:
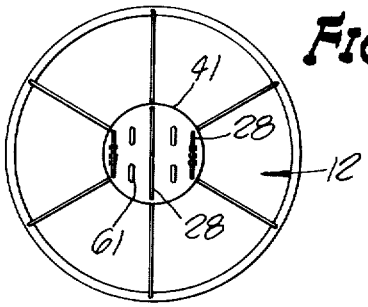
FIG. 6 is a view similar to FIG. 5 showing an alternate embodiment of the invention employing six support strands.

FIGS. 5 and 6 show schematically alternative embodiments of the invention wherein a circular plate 41 acts to secure the strand pair to the horizontal support member (not shown). In FIG. 5 a swing similar to that shown in FIG. 1 is supported by means of strand pairs 31, 32 and 33, 34 which pass through perforations 44, 45 and 46, 47 in the plate 41 such that the effective anchor points of the individual strands are congruently situated at their anchor points with the points at which the strands pass through the disc. In each strand situation the bight 28 of the strand passes along the top of the plate and then through the opposed perforation. Wedges or knots (not shown) may prevent slippage.

In FIG. 6 a similar plate 41 secures 3 strand pairs which are fixed to the disc 12 at equally spaced peripheral points and are congruently secured to the plate 41 in the manner described with respect to the embodiment of FIG. 5. Again the support member is now shown.

While 4 and 6 strand embodiments have been illustrated, the invention does not preclude support strands of 8 or more in number. Selection of the number strands depends upon the strength of the strand the design load anticipated.

Figure 7:
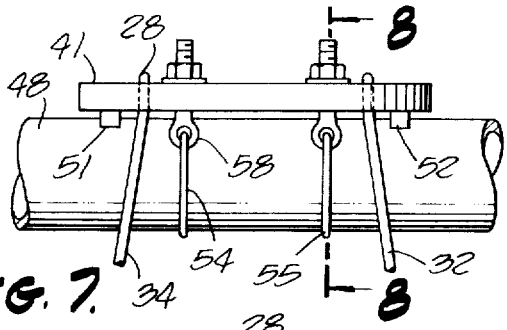
FIG. 7 is a fragmentary elevational view of an alternate embodiment of the invention employing a support member plate.
Figure 8:
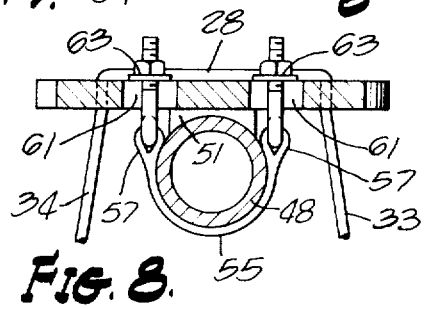
FIG. 8 is a fragmentary sectional elevation taken along line 8—8 of FIG. 7.

The embodiment of FIG. 5 is more clearly illustrated in the fragmentary views of FIG. 7 and 8 wherein a horizontal support member 48 supports a plate 41. Plate saddles 51, 52 make contact between the plate and support member 48. The plate is further anchored to the support member by means of straps 54, 55 each of which has an end loop 57 linked to conventional eye-bolts 58 which pass through elongate apertures 61 in the plate to be secured by conventional nut and washer combinations 63. The position of the eye bolts in their penetration of the securing plate may thus be adjusted to accommodate varying horizontal member sizes.

As in the previously described embodiment of FIG. 5 the strands 31 through 34 pass across the top of the plate and the position of the bight is secured both by the frictional contact of the portion 28 and the passage of the strands through the aperatures 44 through 47 of the plate.

Figure 10:
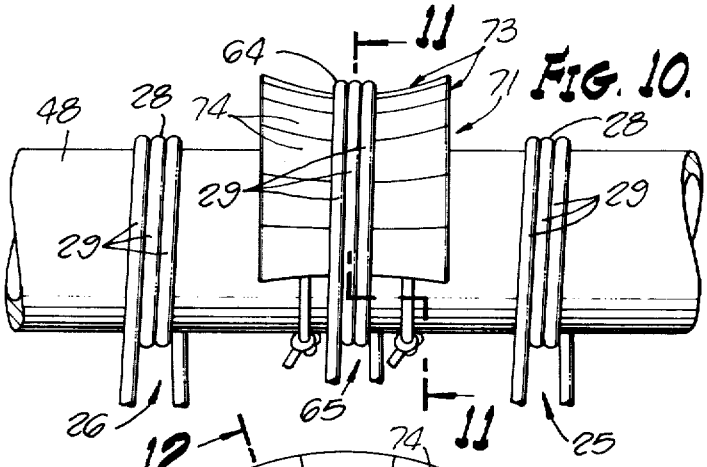
FIG. 10 is a fragmentary elevational view of a further alternate embodiment of the invention employing a central support divider.
Figure 11:
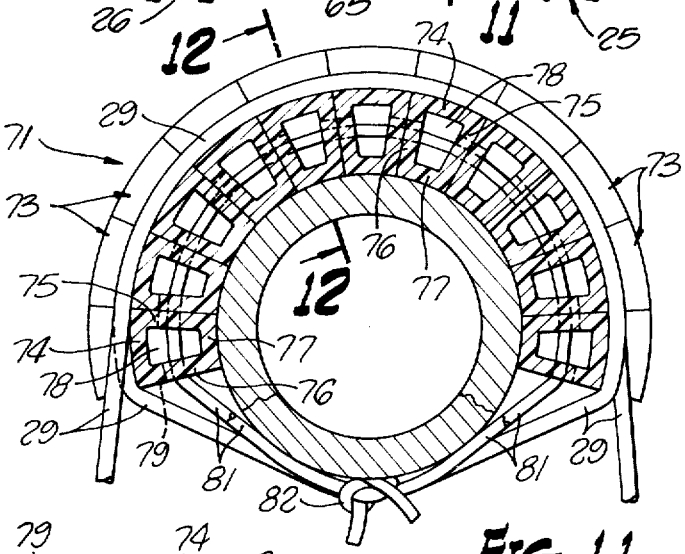
FIG. 11 is a fragmentary transverse section taken along line 11—11 of FIG. 10.
Figure 12:
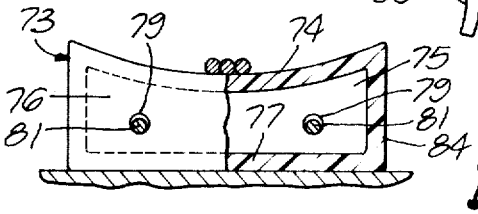
FIG. 12 is a fragmentary elevational section taken along line 12—12 of FIG. 11.

FIGS. 10 through 12 illustrate a further alternate embodiment of the invention in which three strand pairs support the user disc (not shown). As can be seen in FIG. 10 the bights 28 and 64 of the three strand pairs 25, 26 and 65 respectively are supported on a horizontal support member 48. Pairs 25 and 26 are wrapped in bight strands 29 directly about the horizontal support member. However, the securing strands 29 of strand pair 65 are wrapped not only around the horizontal support member but about an arcuate and segmented separator saddle 71. The separator saddle serves to preserve the space along the support member between the various strand bights. It may also be used for strand pairs other than the central pair of a 6-strand support system to increase the effective diameter of the support member and thus afford more securing friction for fixing the strands to the horizontal support member.

FIG. 11 which is taken along the line 11—11 of FIG. 10, shows a plurality of saddle segments 73 which are substantially identical. Each saddle segment is wedge-shaped in cross-section and has a concave outer surface 74 integrally formed with sidewalls 75, 76 which connect to an innerwall 77 adapted to contact the horizontal support member. The walls 74–77 define a cavity 78. The wedges are each made of a resilient material such as rubber or rubberlike plastic materials, resiliency being aided by the presence of the cavity.

As can be seen from FIG. 12, each of the sidewalls 75, 76 have a pair of spaced aperatures 79 through which a tie cord 81 is threaded to unite the segments into the saddle 71. The cords' ends may be tied or otherwise secured by a knot 82 as shown in FIG. 11. Each segment further has an end wall 84 and the segments may be molded in halves or by a blow molding technic as is conventional.

The apparatus of the invention can be seen to be easily adapted to a variety of horizontal support members from tree limbs to conventional playground equipment and installation is simple whether the bight of the strand pairs is secured directly about a limb or secured to the limb or other support member by means like plates 41. The installation of the apparatus is therefore well within the capability of the average user.

Modifications within the scope of the invention other than those shown in the exemplary drawings and described in the foregoing specification will occur to those skilled within this art. I therefore desire that the invention be measured by the appended claims rather than by the illustrative description and drawing of this disclosure.

I claim:

1. A swing to be supported from a horizontal support member for both arcuate and rotational motion and comprising a rider support disc, a peripheral rim on the disc, said rim having top and bottom walls, a plurality of substantially vertical apertures extending through said walls of said rim of said disc, a plurality of support strands, means for fixing the strands at spaced positions about the horizontal support member, a semi-spherical depression in said bottom wall of the disc adjacent each vertical aperture in said wall, a lock bar across the hollow defined by the semi-spherical depression, and a radially intruding boss on the disc containing said bar and said hollow, each semi-spherical depression and lock bar cooperating to adjustably secure each opposite end of a strand passing through a vertical aperture to said disc, the ends of said strands being congruently arranged with respect to the disc as the strands are arranged with respect to the horizontal support member.

2. A swing in accordance with claim 1 wherein the means fixing the strands to the horizontal support member comprises several loops of each strand around said horizontal support member.

3. A swing in accordance with claim 1 wherein the means for fixing the strands to the horizontal support member comprises a plate, having a plurality of spaced apart apertures therein, said plate being secured to said support by at least one attachment member, said apertures defining means for separating the strands with respect to the plate.

4. A swing in accordance with claim 1 wherein the means for fixing the strands to the horizontal support member comprises a plurality of like wedge segments each having an arcuate inner wall, a compound curving outer wall, and radial side walls, an aperture in said side walls and being aligned when the segments are joined in a side by side relationship, and a flexible securing line passing through said apertures sequentially to secure the wedge segments together about said support member.

* * * * *